US007699675B1

(12) United States Patent
Powers et al.

(10) Patent No.: US 7,699,675 B1
(45) Date of Patent: Apr. 20, 2010

(54) MARINE EXHAUST ELBOW WITH CONDENSATION REDUCING WATER CIRCULATION SYSTEM

(75) Inventors: Loren T. Powers, Stillwater, OK (US); Keith S. Ducotey, Stillwater, OK (US); Christopher J. Luckett, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 12/356,108

(22) Filed: Jan. 20, 2009

(51) Int. Cl.
*B63H 20/24* (2006.01)

(52) U.S. Cl. ..... 440/88 J; 440/89 B; 440/89 C

(58) Field of Classification Search ..... 440/88 J, 440/89 B, 89 C
See application file for complete search history.

(56) References Cited

U.S. PATENT DOCUMENTS

| | | | | |
|---|---|---|---|---|
| 3,696,620 | A | 10/1972 | Pace | |
| 3,759,041 | A | 9/1973 | North et al. | |
| 3,780,712 | A | 12/1973 | Pace | |
| 3,798,904 | A * | 3/1974 | Gleason et al. | 60/310 |
| 3,921,398 | A * | 11/1975 | Kashmerick | 60/310 |
| 4,573,318 | A | 3/1986 | Entringer et al. | |
| 4,845,945 | A | 7/1989 | Widmer et al. | |
| 4,866,934 | A | 9/1989 | Lindstedt | |
| 4,977,741 | A | 12/1990 | Lulloff et al. | |
| 4,991,546 | A | 2/1991 | Yoshimura | |
| 5,109,668 | A | 5/1992 | Lindstedt | |
| 5,644,914 | A | 7/1997 | Deavers et al. | |
| 6,290,558 | B1 | 9/2001 | Erickson | |
| 6,346,019 | B1 * | 2/2002 | Nanami | 440/89 R |
| 6,478,645 | B1 | 11/2002 | Allbright et al. | |
| 6,582,263 | B1 | 6/2003 | Jaeger et al. | |
| 6,652,337 | B1 | 11/2003 | Logan et al. | |
| 6,800,004 | B1 | 10/2004 | White et al. | |
| 6,929,520 | B1 | 8/2005 | Hughes et al. | |
| 7,427,222 | B2 | 9/2008 | Auck et al. | |

* cited by examiner

*Primary Examiner*—Stephen Avila
(74) *Attorney, Agent, or Firm*—William D. Lanyi

(57) ABSTRACT

An exhaust system of a marine propulsion device is provided with a bifurcated cooling passage in its elbow structure in order to limit the effect of cold water being disposed in thermal communication with exhaust gas passing through the elbow structure. This thermal communication between a stream of cold water and exhaust gas passing through the elbow structure is minimized in order to reduce the likelihood that water vapor will condense out of the stream of exhaust gas as it passes through the elbow structure. An obstruction, or water dam, is used to bifurcate the coolant chamber within the elbow structure while allowing passage of coolant through the obstruction.

14 Claims, 8 Drawing Sheets

MARINE EXHAUST ELBOW WITH CONDENSATION REDUCING WATER CIRCULATION SYSTEM

BACKGROUND OF THE INVENTION

1. Field of the Invention

The present invention is generally related to a marine propulsion system and, more particularly, to a propulsion system that circulates cooling water through water jackets of its exhaust elbows in a manner that reduces the affected surface area in thermal communication with cooling water from a body of water so that condensation of water vapor entrained in the exhaust gas stream is reduced.

2. Background

Those skilled in the art of marine propulsion systems are familiar with various techniques used to conduct exhaust gas away from an internal combustion engine and emit the exhaust gas at a location behind a watercraft. In some applications, the exhaust gas is directed to flow through a marine drive unit and through the central opening of a propeller. In other applications, exhaust gas can be directed to flow through outlets above the surface of a body of water in which the marine vessel is operated. Regardless of the particular routing system used to conduct the flow of exhaust gas to a location behind the watercraft, the vast majority of marine propulsion systems collect the exhaust from the cylinders of an engine, in a manifold structure of some type, and then direct the exhaust gas through an elbow that is connected to one or more exhaust pipes. Typically, in V-type engines, two manifolds and two elbows are used.

U.S. Pat. No. 3,696,620, which issued to Pace on Oct. 10, 1972, describes a marine engine water cooling device. Improved water jacketed manifolds and water cooling systems for marine engines are described. Water circulation through the manifold water jacket is provided through an apertured pipe which extends through the jacket.

U.S. Pat. No. 3,759,041, which issued to North et al. on Sep. 18, 1973, discloses an exhaust water separator for marine engines. Arcuate exhaust elbows are provided which force cooling water in the exhaust to the outside by centrifugal action. This water is removed and expelled through the transom.

U.S. Pat. No. 3,780,712, which issued to Pace on Dec. 25, 1973, describes marine engine cooling. Heated water which is circulated through an engine cooling system for cooling purpose is mixed in the improved engine exhaust manifold water jacket with raw, relatively cool water to controllably cool the manifold and avoid condensing water from the exhaust gases flowing through the exhaust manifold.

U.S. Pat. No. 4,573,318, which issued to Entringer et al. on Mar. 4, 1986, discloses an exhaust elbow for a marine propulsion system. The exhaust elbow has an intake exhaust passage extending upwardly from the engine and communicating through a bend with a discharge exhaust passage, and a water jacket having pockets around the exhaust passages for cooling the latter. A central channel extends longitudinally along the exterior of the exhaust passages to guide water there along to the end of the discharge exhaust passage to mix with exhaust thereat. The central channel has a pair of sidewalls extending longitudinally and laterally tapered away from each other at the outer end of the discharge exhaust passage to create an outward draw from the central channel to minimize break-up of longitudinally outward water flow and maintain the end tip of the discharge exhaust passage dry and prevent water ingestion and creeping back into the discharge exhaust passage due to pulsations of the engine. Dam and port structure is also provided enabling faster heating of the exhaust passage and in turn minimizing condensation within the elbow which may otherwise ingest back into the engine.

U.S. Pat. No. 4,845,945, which issued to Widmer et al. on Jul. 11, 1989, discloses an exhaust elbow trough. A water jacketed exhaust elbow for a marine propulsion system includes an intake exhaust passage communicating with a discharge exhaust passage, a water jacket around the exhaust passages, and a trough member extending longitudinally along the water channel along the exterior of the discharge exhaust passage to guide water therealong to mix with exhaust at the end of the discharge exhaust passage. The trough member extends beyond the end tip of the discharge exhaust passage and has a sharp edge providing a clean parting surface for the coolant water and preventing ingestion of water back into the discharge exhaust passage.

U.S. Pat. No. 4,866,934, which issued to Lindstedt on Sep. 19, 1989, discloses a marine drive exhaust system with shaped O-ring seals. The exhaust system is provided with resilient, shaped rubber O-ring seals between facing surfaces of the exhaust manifold and exhaust elbow, and the facing surfaces of the exhaust elbow and the exhaust pipe. Each of the shaped O-ring seals has an inner peripheral rib extending peripherally around the exhaust passage and generally conforming to the shape thereof and being spaced laterally between the exhaust passage and the peripheral water passage. Each of the shaped O-ring seals has an outer peripheral rib extending peripherally around the water passages and spaced laterally outward of the inner rib by a gap through which the water passages extend.

U.S. Pat. No. 4,977,741, which issued to Lulloff et al. on Dec. 18, 1990, discloses a combination exhaust manifold and elbow for marine propulsion systems. A combination exhaust manifold and exhaust elbow for an internal combustion engine includes an exhaust cavity for receiving exhaust from the engine, an exhaust passage leaving from the exhaust cavity, and an exhaust discharge outlet. A first water jacket is provided around the exhaust cavity and a second water jacket is provided around the exhaust discharge passage. A dam is provided between the first and second water jackets, having a passage therein for allowing fluid communication between the first and second water jackets. A warm water inlet is provided in the first water jacket around the exhaust cavity for receiving cooling water which has been warmed by the engine, and which flow is controlled by a temperature sensitive thermostat. A cold water inlet is provided adjacent the discharge exhaust passage. The cold water inlet is disposed either upstream or downstream of the dam adjacent the exhaust passage, and allows cold bypass water to be discharged without the necessity of the cold water flowing through the entire assembly, so as to prevent moisture from condensing out of the exhaust in the exhaust cavity.

U.S. Pat. No. 4,991,546, which issued to Yoshimura on Feb. 12, 1991, describes a cooling device for a boat engine. A number of embodiments of cooling systems for internal combustion engines powering marine watercraft are described. The engine coolant jacket delivers its coolant to an exhaust manifold cooling jacket adjacent the inlet end of the exhaust manifold. Coolant is delivered from the exhaust manifold cooling jacket to a further cooling jacket around the inlet portion of an exhaust elbow. In one embodiment, a cooling jacket system is provided for the engine cooling jacket, exhaust manifold cooling jacket and the elbow cooling jacket. In another embodiment, the system discharges coolant back to the body of water in which the watercraft is operating through a further cooling jacket of the exhaust elbow that communicates with its discharge end.

U.S. Pat. No. 5,109,668, which issued to Lindstedt on May 5, 1992, discloses a marine exhaust manifold and elbow. An exhaust assembly includes a manifold portion, an elbow portion, a water jacket portion, and exhaust runner walls, providing a smooth continuous transition of exhaust gas flow from intake exhaust passages in the manifold portion to transfer exhaust passages in the elbow portion around a bend to a discharge exhaust passage, minimizing turbulent flow of exhaust through the manifold portion and elbow portion.

U.S. Pat. No. 5,644,914, which issued to Deavers et al. on Jul. 8, 1997, discloses an exhaust pressure pulsation control apparatus for a marine propulsion system. It has a front ring and a reflector disk located downstream of the front ring. There is a space between the front ring and the reflector disk that is sufficiently large so that the mixture of water and water cooled exhaust passing through the apparatus does not have a significant pressure drop. The apparatus attenuates pressure pulsations in the exhaust system, thereby significantly reducing water ingestion through the exhaust system into the engine. The apparatus does not create significant exhaust back pressure, and typically increases engine maximum power output.

U.S. Pat. No. 6,290,558, which issued to Erickson on Sep. 18, 2001, discloses an exhaust elbow with a water trap for a marine propulsion system. The water trap section defines a water collection cavity. Within the water trap section, a barrier extends downward into the water collection cavity to define first and second exhaust passages. When water begins to collect in the water collection cavity, the cross-sectional area of the exhaust passage is reduced and the velocity of exhaust gases passing through the exhaust passage is increased. The water collection cavity is shaped to be easily cleared when exhaust gas pressure increases as the engine speed increases.

U.S. Pat. No. 6,478,645, which issued to Allbright et al. on Nov. 12, 2002, describes a moisture migration inhibitor for wet marine exhaust. A moisture inhibitor system for wet exhaust as utilized in marine applications, such as boats and other watercraft, is described. The preferred embodiment contemplates an exhaust manifold having an inner exhaust passage which has situated therein a collection barrier or raised pocket situated to collect moisture migrating from the exhaust port, generally at the stern of the vessel. The collection pocket is heated by the exhaust stream and is formed to collect and retain the migrating moisture while simultaneously the heated walls of the collection barrier evaporate the collected moisture forming moisture vapor which moisture vapor is urged through the exhaust passage and the exhaust port, where it leaves the system.

U.S. Pat. No. 6,582,263, which issued to Jaeger et al. on Jun. 24, 2003, discloses a marine exhaust elbow structure with enhanced water drain capability. The elbow is provided with a stainless steel tube within a water outlet opening to assure that a drain opening remains open even when the exhaust elbow is exposed to a corrosive environment. Since cast iron tends to expand in volume as a result of corrosion of its surface areas, water outlet openings intended to perform a draining function can be partially or fully closed as a result of corrosion. The insertion of a stainless steel tube in one or more water outlet openings of an exhaust elbow assures that an internal water cavity of the elbow can drain when the associated internal combustion engine is turned off, thereby minimizing the possibility of freeze damage to the exhaust components.

U.S. Pat. No. 6,652,337, which issued to Logan et al. on Nov. 25, 2003, discloses an exhaust system for a marine propulsion engine. A relationship between the exhaust passages and coolant passages of an exhaust manifold and exhaust elbow serves to maintain the joint of the exhaust passage at a higher temperature than would be possible with known exhaust manifolds and exhaust elbows. By providing a space between surfaces of a raised exhaust portion of the components and surfaces of the raised coolant portions of the exhaust system, leakage from the coolant conduit to the exhaust cavities is avoided.

U.S. Pat. No. 6,800,004, which issued to White et al. on Oct. 5, 2004, discloses a marine exhaust cooling system. It uses an orifice to distribute liquid coolant flow between two alternative and parallel paths. One coolant path passes through a generally horizontal portion of an exhaust elbow and the other coolant path passes through the orifice and directly to a vertical riser of the exhaust elbow. The ratio of flow between the two paths changes as a function of engine speed because of the operation of the orifice which provides increased resistance to flow as a function of increased pressure drop across the orifice.

U.S. Pat. No. 6,929,520, which issued to Hughes et al. on Aug. 16, 2005, discloses a cooling method for a marine propulsion system. It directs a portion of a recirculating stream of cooling water to a first portion of an exhaust manifold so that the cooling jacket of the exhaust manifold can be maintained in a filled condition. Water flows upwardly through the cooling jacket and exits through a port in the exhaust manifold back into a recirculating stream of cooling water that passes through a recirculation pump, the cooling passage of an engine, and a cavity of a thermostat housing.

U.S. Pat. No. 7,427,222, which issued to Auck et al. on Sep. 23, 2008, describes a reversion control device for a watercraft exhaust system. The device is a reversion control device including a housing for a stationary vane and a flapper. In one example, the housing includes an expansion chamber to house the stationary vane and the flapper.

The patents described above are hereby expressly incorporated by reference in the description of the present invention.

Marine propulsion systems normally draw water from a body of water in which the marine vessel is operating and direct the water to flow through various devices in order to remove heat from heat producing components. The temperature of the water drawn from the body of water can vary significantly, depending on the season of the year and the geographical region where the body of water is located. The exhaust gases produced by the engine contain water vapor. Exposing the stream of exhaust gas to low temperatures caused by the use of cold cooling water can result in condensation within the exhaust conduits of the system. The formation of condensation can be significantly disadvantageous, as described within numerous ones of the patents cited above. Among these disadvantages is the potential flow of condensed water back toward the exhaust ports of the engines' cylinders. In addition, if the engine is provided with one or more catalyst devices, the condensed water can possibly flow toward and in contact with the catalyst components. It would therefore be significantly advantageous if the creation of condensed water vapor in the exhaust conduits could be reduced or eliminated.

SUMMARY OF THE INVENTION

A marine exhaust system made in accordance with a preferred embodiment of the present invention comprises a manifold structure, an elbow structure attached to the manifold structure, a manifold exhaust conduit formed within the manifold structure and configured to direct a flow of exhaust gas from an engine through a collection chamber of the manifold exhaust conduit to an outlet cavity of the manifold exhaust conduit, a manifold cooling jacket disposed around a substantial portion of the manifold exhaust conduit, an elbow exhaust conduit formed within the elbow structure and configured to direct a flow of exhaust gas from an inlet opening to an outlet opening, an elbow cooling jacket disposed around a substantial portion of the elbow exhaust conduit, and an obstruction disposed within the elbow cooling jacket. The elbow exhaust conduit is connected in fluid communication with the manifold exhaust conduit to direct the flow of exhaust gas from the outlet cavity to the inlet opening. The obstruction is configured to divide the elbow cooling jacket into an inlet portion which surrounds a substantial portion of an inlet section of the elbow exhaust conduit and an outlet portion which surrounds a substantial portion of an outlet section of the elbow exhaust conduit, wherein the obstruction has a passage formed therein to conduct fluid between the inlet portion and the outlet portion.

In a preferred embodiment of the present invention, it further comprises a gasket disposed between the manifold structure and the elbow structure. In one embodiment of the present invention, the gasket has an opening formed through its thickness and configured to connect the manifold cooling jacket in fluid communication with the elbow cooling jacket. In an alternative embodiment of the present invention, the gasket is configured to prevent fluid communication between the manifold cooling jacket and the elbow cooling jacket.

In a particularly preferred embodiment of the present invention, the marine exhaust system further comprises a first port connected in fluid communication with the outlet portion to continuously conduct fluid into the outlet portion when the engine is operating. It can further comprise a second port connected in fluid communication with the inlet portion to conduct fluid into the inlet portion when the pressure of the fluid, pumped from a body of water, exceeds a predefined threshold magnitude.

In a particularly preferred embodiment of the present invention, the exhaust system further comprises a catalyzing component disposed within the outlet cavity of the manifold exhaust conduit and configured to conduct a substantial portion of the flow of exhaust gas through the catalyzing component. The catalyzing component can be retained in place by a portion of the catalyzing component being disposed between opposing surfaces of the manifold structure and the elbow structure.

In certain embodiments of the present invention, the manifold cooling jacket is connected in fluid communication with a cooling jacket of the engine within a closed cooling system, a first coolant being contained within the closed cooling system for recirculation through the manifold cooling jacket and the cooling jacket of the engine. The elbow cooling jacket, in this particular embodiment of the present invention, is isolated from the manifold cooling jacket and the cooling jacket of the engine. A second coolant is directed to flow through the elbow cooling jacket. In a preferred embodiment of the present invention, the second coolant is water drawn from a body of water.

In certain embodiments of the present invention, the manifold cooling jacket is connected in fluid communication with a cooling jacket of the engine and with the elbow cooling jacket within an open cooling system. A first coolant is directed to flow through the open cooling system for passage through the cooling jacket of the engine, the manifold cooling jacket and the elbow cooling jacket. The second coolant is water drawn from the body of water in this embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
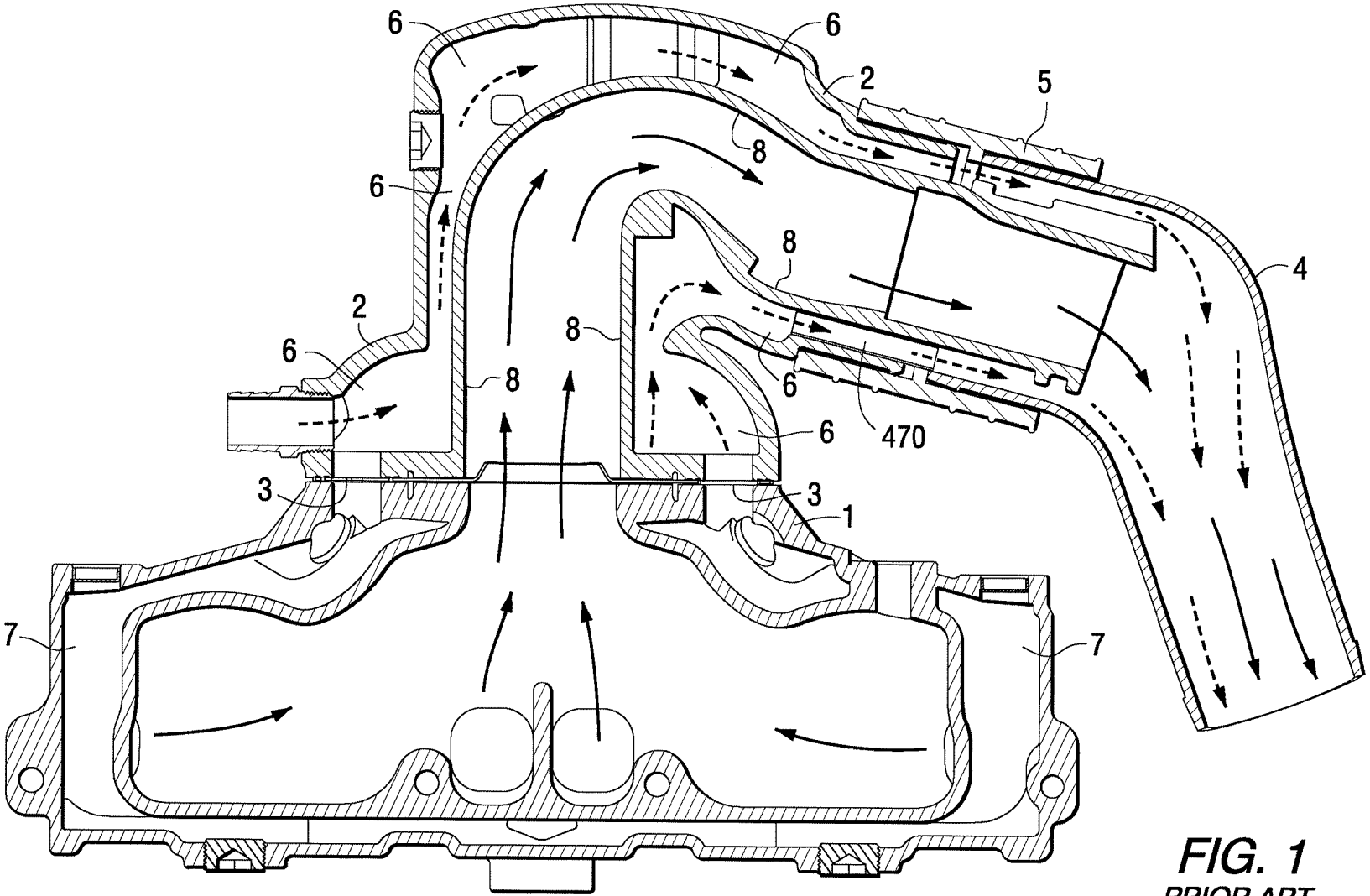
FIG. 1 PRIOR ART
FIG. 1 is a section view of a manifold and elbow structure generally known to those skilled in the art.

Throughout the description of the preferred embodiment of the present invention, like components will be identified by like reference numerals.

FIG. 1 is a side section view of a known type of manifold 1 and an elbow 2 with a gasket 3 disposed between them. Exhaust gas, represented by solid line arrows in FIG. 1, is collected in the main chamber of the manifold 1 and directed into the elbow 2 which directs the flow of exhaust gas into an exhaust pipe 4 which is connected to the elbow 2 by an elastomeric tube 5 which is occasionally referred to as a "bellows". Cooling water, represented by dashed line arrows in FIG. 1, is introduced into a water jacket 6 of the elbow 2 in order to control its temperature. The water, after flowing through the water jacket 6 of the elbow 2, is mixed with the exhaust gas and directed away from the elbow. Those skilled in the art of marine propulsion systems and engine exhaust systems for watercraft are familiar with the basic structure illustrated in FIG. 1. Reference numeral 8 is used in FIG. 1 to identify the internal surface of the exhaust gas conduit within the elbow 2. Virtually all of this internal surface 8 is in thermal communication with the water flowing through the water jacket 6 of the elbow 2. When the water, represented by dashed line arrows in FIG. 1, is cold this thermal communication with surface 8 can cause water vapor within the flow of exhaust gas, represented by solid line arrows in FIG. 1, to condense on the surface 8 of the walls of the elbow 2. When the surface area of the walls within the exhaust gas passage is large and the water flowing through the water jacket 6 is cold, there exists a significant likelihood that liquid water will condense on surface 8 and some of that water can flow in a reverse direction toward the manifold 1. In certain particularly deleterious circumstances, this water can flow downwardly into the exhaust ports of the cylinders of the engine. As will be described in greater detail below, various embodiments of the present invention are directed toward avoiding this disadvantageous situation.

Figure 2:
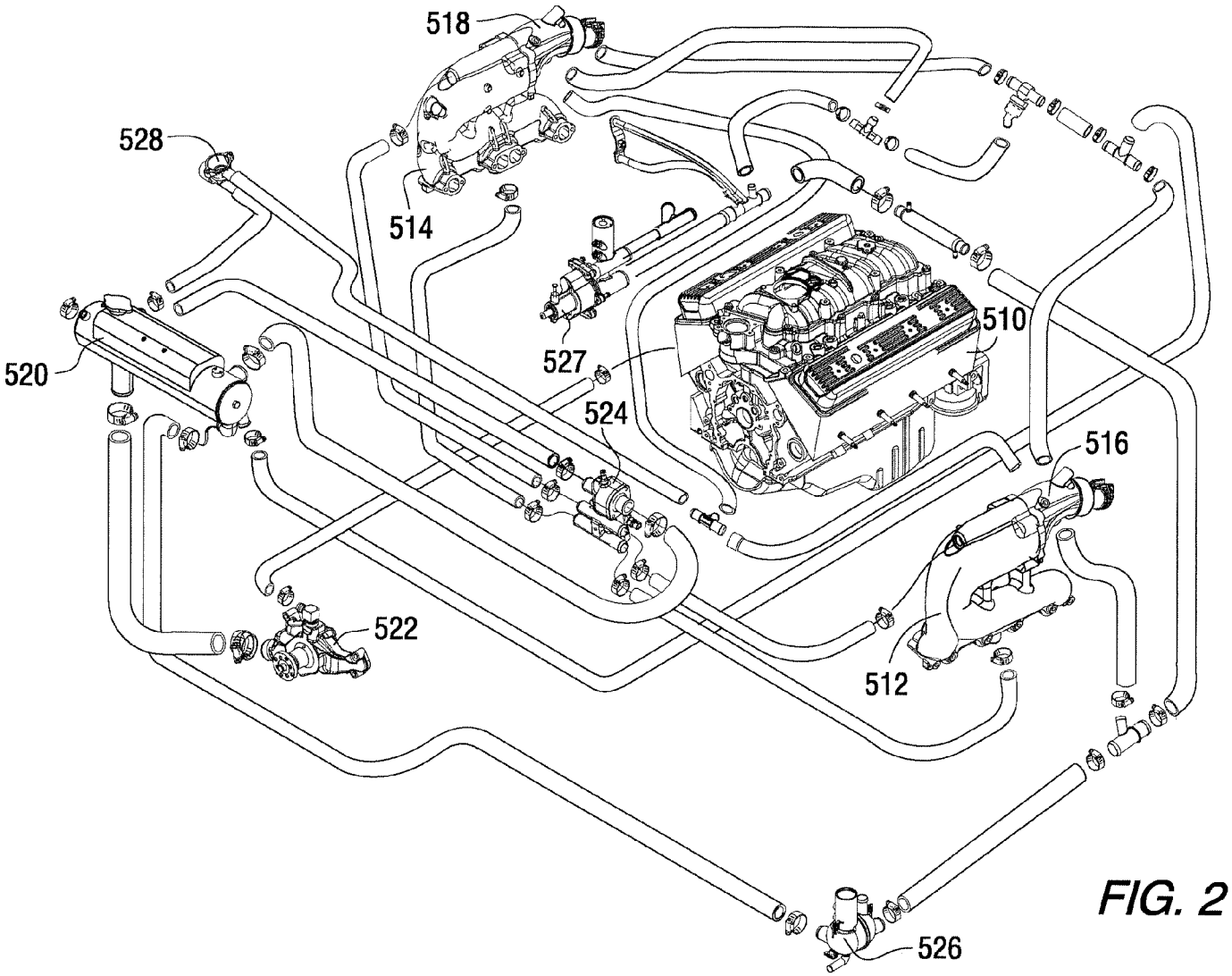
FIG. 2 is an exploded isometric view of an exhaust and cooling system of a marine vessel.

FIG. 2 is an exploded isometric representation of a marine engine and certain selected peripheral components. Also shown in FIG. 2 are port 512 and starboard 514 manifolds which are attached to port 516 and starboard 518 elbows, respectively. A heat exchanger is identified by reference numeral 520 in FIG. 2 along with a recirculation pump 522, a thermostat housing 524, a distribution housing 526, a water pump 527, and a representation of a portion of a poppet valve 528 which, as will be described in greater detail below, selectively directs water to the elbows, 516 and 518, in a preferred embodiment of the present invention. FIG. 2 also shows numerous fittings, clamps, and hoses which will not be described in detail herein.

Figure 3:
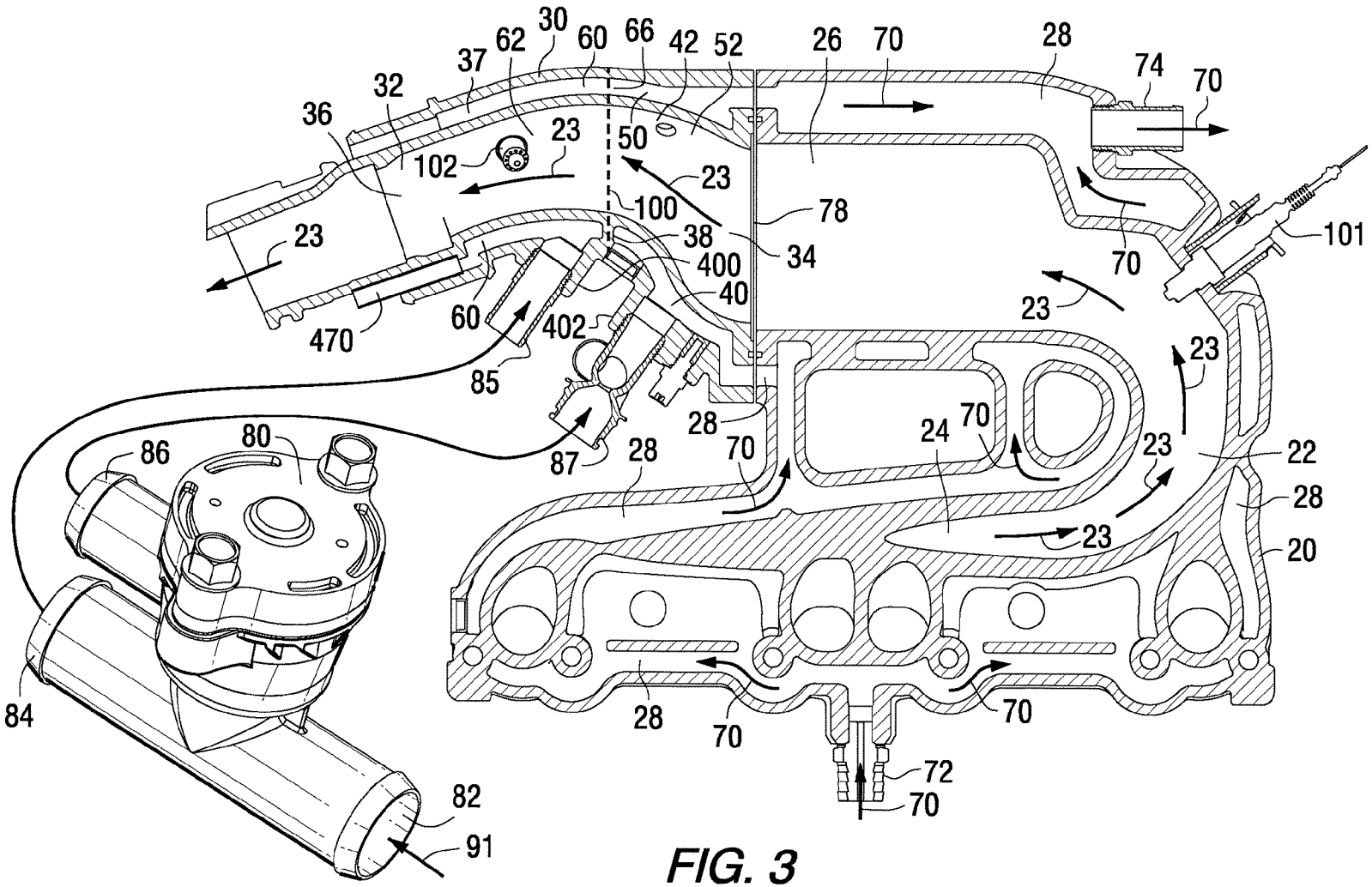
FIG. 3 shows a section view of one preferred embodiment of the present invention illustrated in conjunction with a pressure responsive valve.

FIG. 3 shows a section view of a manifold structure 20 and an elbow structure 30. A manifold exhaust conduit 22 is formed within the manifold structure 20 and configured to direct a flow of exhaust gas 23 from an engine 510, such as that illustrated in FIG. 2, through a collection chamber 24 of the manifold exhaust conduit to an outlet cavity 26. A manifold cooling jacket 28 is disposed around a substantial portion of the manifold exhaust conduit 22. An elbow exhaust conduit 32 is formed within the elbow structure 30 and configured to direct a flow of exhaust gas 23 from an inlet opening 34 to an outlet opening 36. The elbow exhaust conduit 32 is connected in fluid communication with the manifold exhaust conduit 22 in order to direct the flow of exhaust gas 23 from the outer cavity 26 to the inlet opening 34. An elbow cooling jacket 37 is disposed around a substantial portion of the elbow exhaust conduit 32. An obstruction 38 is disposed within the elbow cooling jacket 37. The obstruction 38 is configured to divide the elbow cooling jacket 37 into an inlet portion 50 which surrounds a substantial portion of an inlet section 52 of the elbow exhaust conduit 32 and an outlet portion 60 which surrounds a substantial portion of an outlet section 62 of the elbow exhaust conduit 32. The obstruction 38 has a passage 66 formed therein to conduct fluid between the inlet portion 50 and the outlet portion 60. The passage 66 will be described below in conjunction with FIG. 4.

With continued reference to FIG. 3, it should be understood that the manifold 20 and elbow 30 can be used in either a closed cooling system or an open cooling system. The representation shown in FIG. 3 is intended for use in a closed cooling system. In a marine propulsion system that incorporates a closed cooling system, a coolant is recirculated through the block and head of the engine and heat is removed from that coolant through the use of a heat exchanger such as the one identified by reference numeral 520 in FIG. 2. In FIG. 3, arrows 70 represent the path that a coolant would take in a system of this type. Typically, an ethylene glycol mixture is recirculated through the cooling passages of the engine and other components, such as the manifold 20 in FIG. 3, and then passed through a heat exchanger to remove heat from that coolant. The coolant is introduced through fitting 72 and exits from the elbow cooling jacket 28 through fitting 74. In conjunction with a closed cooling system, the gasket 78 blocks passage of the coolant from the manifold cooling jacket 28 to the elbow cooling jacket 37.

With continued reference to FIG. 3, a pressure responsive valve 80 is shown in the lower left portion of the figure. The isometric representation of the pressure responsive valve 80 illustrates an inlet conduit 82, an outlet conduit 84, and a pressure relief conduit 86. Arrow 91 represents water flowing from a heat exchanger, like heat exchanger 520 in FIG. 2, after it is pumped from a body of water by a pump, like that identified by reference numeral 527 in FIG. 2. The components shown in FIG. 3 are associated with a closed cooling system. However, it should be understood that various embodiments of the present invention can also be used in association with open cooling systems. Naturally, open cooling systems do not use a heat exchanger. Instead, water is pumped from a body of water and circulated through the cooling jackets of the engine block, heads, and exhaust manifolds.

The water flows from the heat exchanger or from a thermostat bypass passage to the inlet conduit 82 of the pressure responsive valve 80 and then from the outlet 84 to a fitting 85 which directs the water flow into the outlet portion 60 of the elbow cooling jacket 37. In association with a closed cooling system, water can be directed from the pressure relief conduit 86 into fitting 87 which conducts that water into the inlet portion 50 of the elbow cooling jacket 37. The passage 66 formed in the obstruction 38 allows water to flow between the inlet and outlet portions, 50 and 60, of the elbow cooling jacket 37. The direction of flow through the passage 66, in open cooling systems, depends on the immediately preceding operation history of the marine propulsion system, the temperature of the elbow 30, and the relative pressures of the fluid within the inlet and outlet portions, 50 and 60, of the elbow cooling jacket 37.

Figure 4:
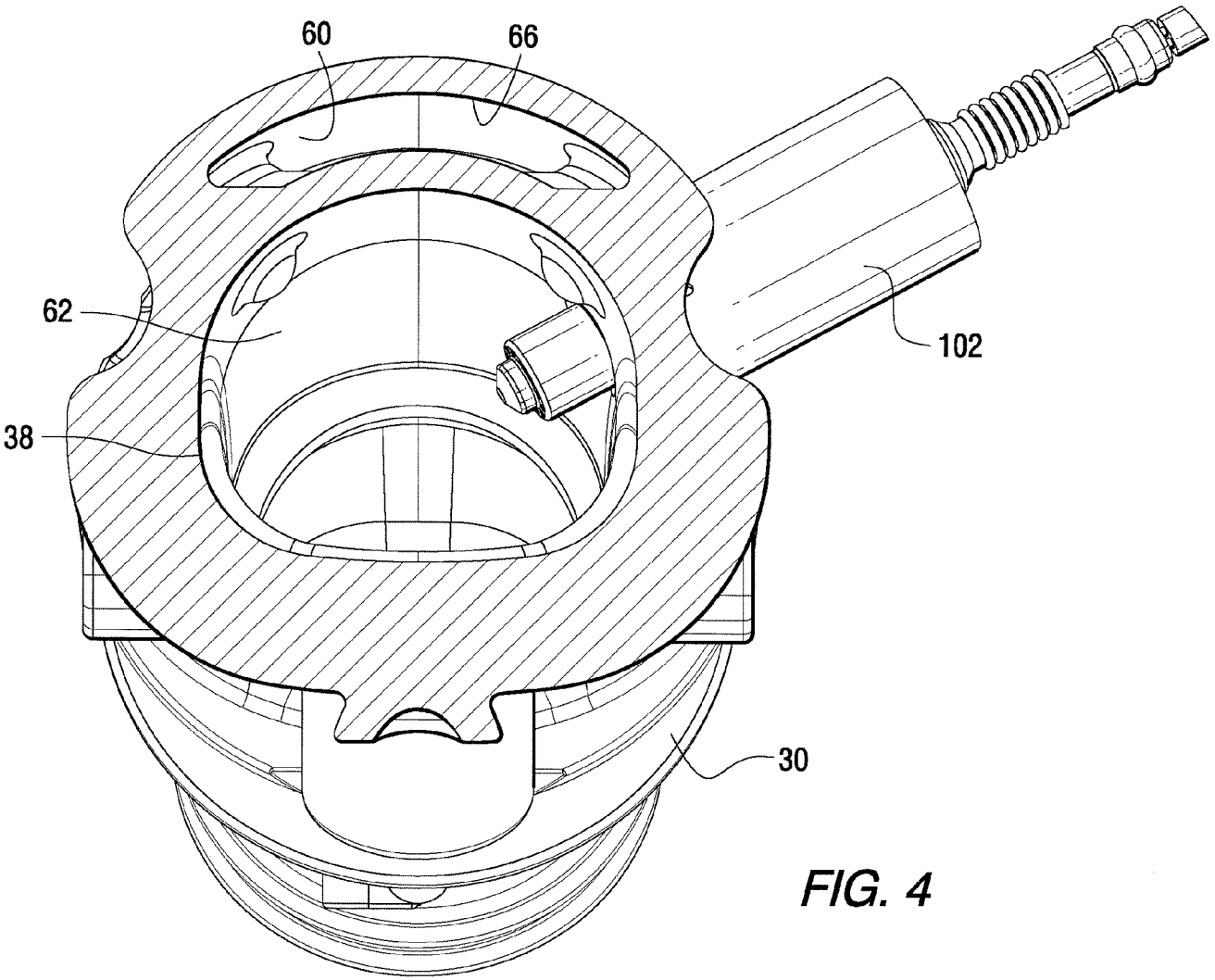
FIG. 4 is a section view of a portion of FIG. 3.

FIG. 4 is a section view taken through the portion of the elbow 30 in FIG. 3 at the obstruction 38. The passage 66 is shown formed through the obstruction 38 at an upper region of the exhaust elbow.

With continued reference to FIGS. 3 and 4, two oxygen sensors, 101 and 102, are shown in FIG. 3. In addition, it can be observed that the passage 66 is located at an upper portion of the elbow cooling jacket 37. This has the additional beneficial effect of inducing any condensation formed within the elbow exhaust conduit 32 to flow downwardly toward the distal end of the elbow exhaust conduit and be discharged out of the outlet opening 36 either under the influence of gravity or with the passage of exhaust gas 23 through the elbow structure 30. It can also be observed that the elbow cooling jacket 37 is effectively divided into two sections on both sides of dashed line 100 in FIG. 3. Dashed line 100 is generally coincident with the obstruction 38 which serves as a dam within the elbow cooling jacket 37. The internal wall surface of the elbow exhaust conduit 32 is, essentially, divided into the inlet section 52 and the outlet section 62. The inlet section 52 is influenced by the temperature of the water within the inlet portion 50 of the elbow cooling jacket 37 and the outlet section 62 is influenced by the temperature of the water within the outlet portion 60. Since water flows virtually continuously from the outlet conduit 84 of the pressure responsive valve 80 to fitting 85, the temperature of the water within the outlet portion 60 will typically be much colder than the water within the inlet portion 50. This is particularly true on cold days when the body of water in which the marine vessel is operated is particularly cold. If the inlet portion 50 is generally empty when operation of the engine begins, it will be filled by water that first passes into the outlet portion 60 and then through the passage 66. If the inlet portion 50 is filled with water when the engine operation begins, that water is not likely to be as cold as water freshly drawn from the body of water. The inlet portion 50, once filled with water, becomes stagnant due to this portion of the circuit not flowing. The inlet portion 50 will continue to pick up heat from the exhaust gas. This portion of the circuit will not flow until the pressure responsive valve opens. Therefore, the wall temperature within the elbow exhaust conduit 32 will not be as cold within the inlet section 52 as it is in the outlet section 62. In addition, only a portion of the elbow exhaust conduit surface, to the left of dashed line 100, is exposed to this cold water.

When the engine begins to operate at elevated speeds, the pressure of the cooling water increases significantly. The pressure responsive valve 80 then conducts an increased flow from the pressure relief conduit 86 into fitting 87 and the inlet portion 50 of the elbow cooling jacket. When this occurs, the flow through fitting 87 exceeds the flow through fitting 85 and the flow of water through the passage 66 is from the inlet portion 50 to the outlet portion 60 and then out through the distal end of the elbow 30.

Figure 5:
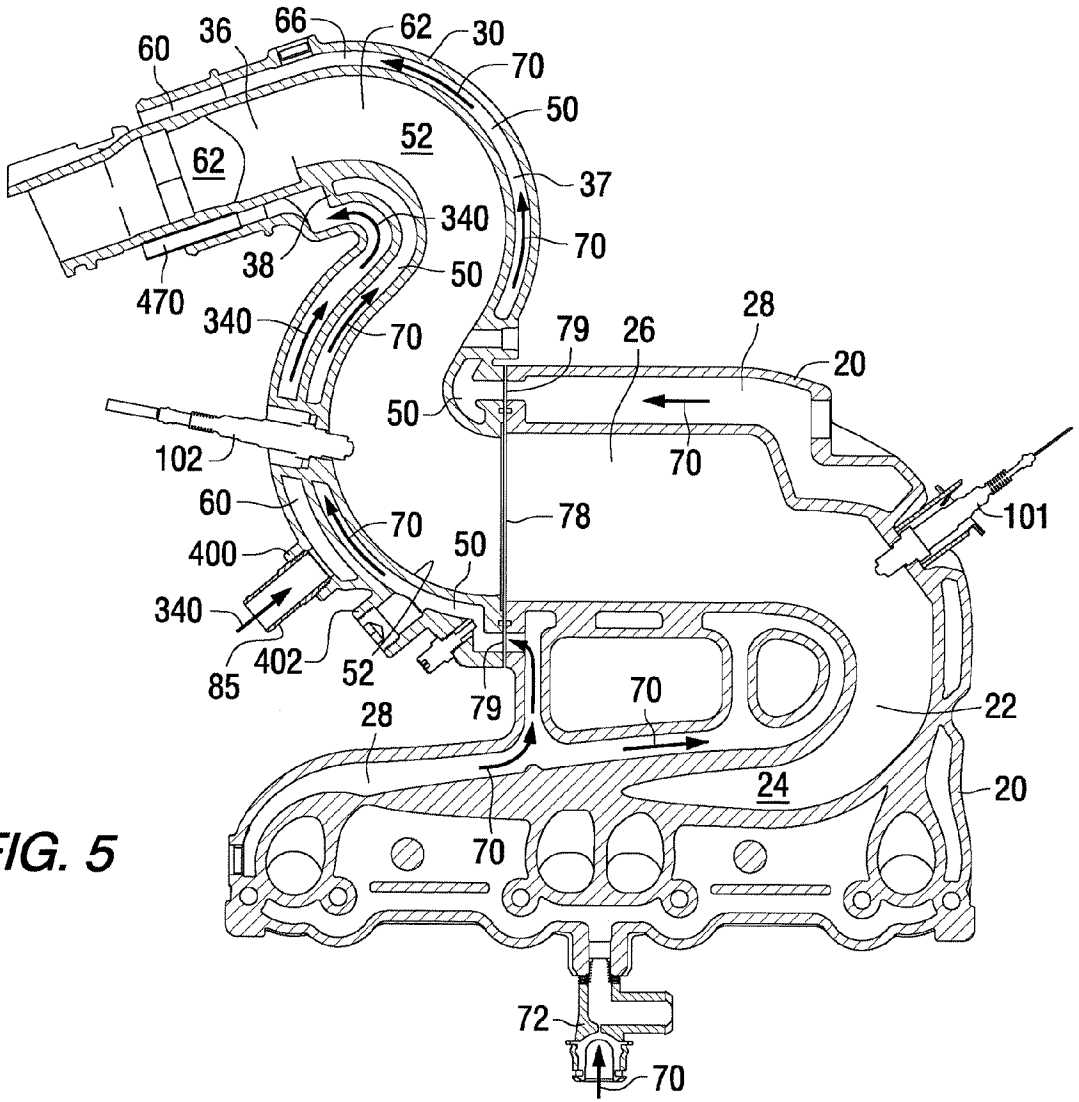
FIG. 5 is a section view of another preferred embodiment of the present invention.
Figures 7, 8:
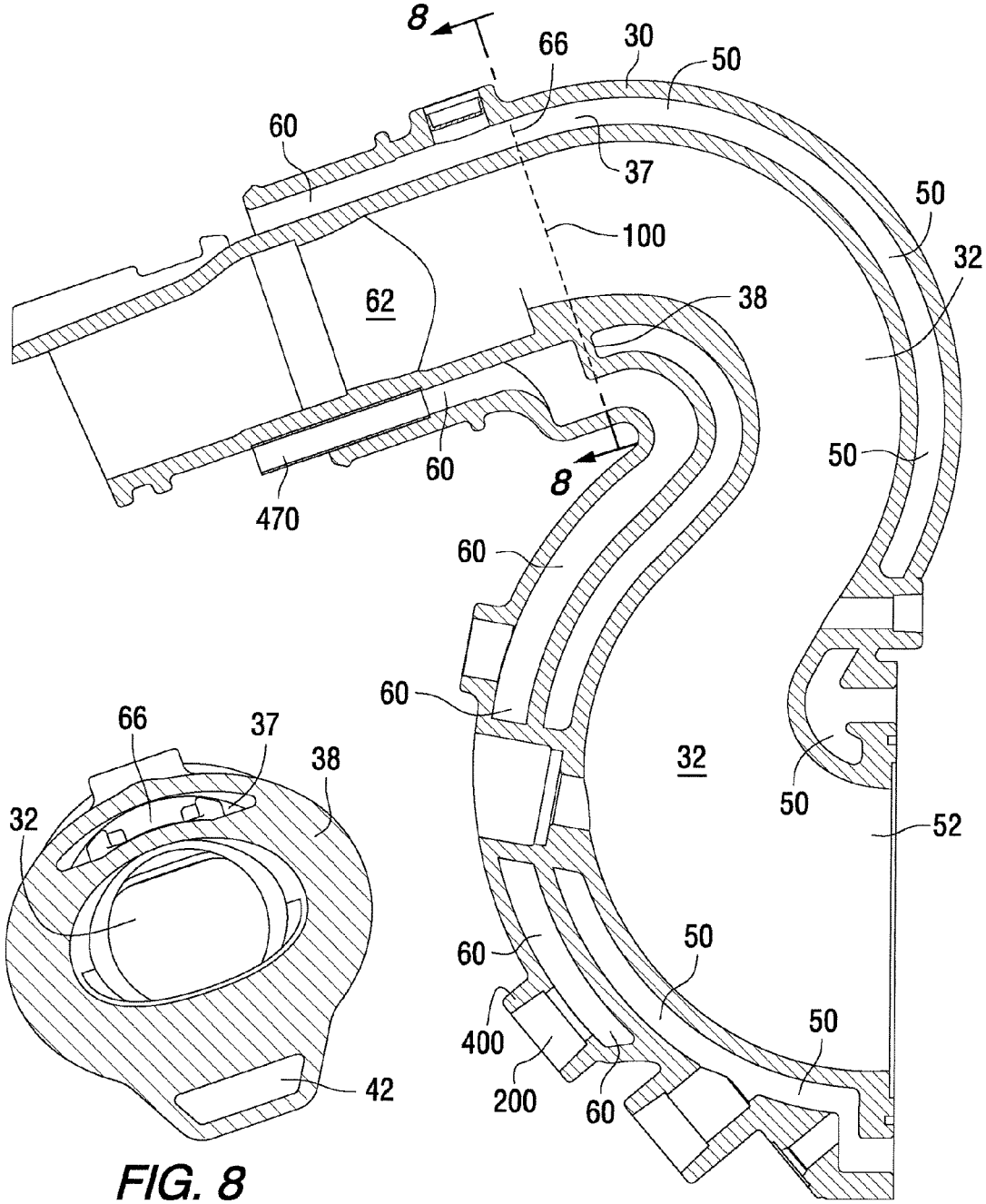
FIG. 7 is a partial section view of a preferred embodiment of the present invention showing an elbow structure.
FIG. 8 is a section view of a portion of FIG. 7.

FIG. 5 is a section view of a manifold structure 20 and elbow structure 30 made in accordance with a preferred embodiment of the present invention, but with an added feature that raises the outlet of the elbow structure 30 to a location higher than results from the use of the structure shown in FIG. 3. The structure shown in FIG. 5 is also an example of the present invention used in association with an open cooling system. Water flows through fitting 72 and into the manifold cooling jacket 28 as represented by arrows 70. This water is directed through the opening 79 formed through the gasket 78 and into the inlet portion 50 of the elbow cooling jacket. The water continues to flow through the inlet portion 50 until it reaches the passage 66 formed in the obstruction 38. The passage 66 is specifically shown in FIGS. 4 and 8 and its location is illustrated in FIGS. 3 and 5 and will also be described in conjunction with FIG. 7 below. The water then flows into the outlet portion 60 of the elbow cooling jacket. Water can also flow through fitting 85 into the outlet portion 60 as represented by arrows 340. These two flows of water, 70 and 340, combine at a point downstream of the obstruction 38 in an open cooling system which incorporates a preferred embodiment of the present invention. FIG. 7, which will be described in greater detail below, also shows the elbow structure 30 illustrated in FIG. 5. FIG. 8 is a section view of a portion of FIG. 7 taken through the obstruction 38.

Figure 6:
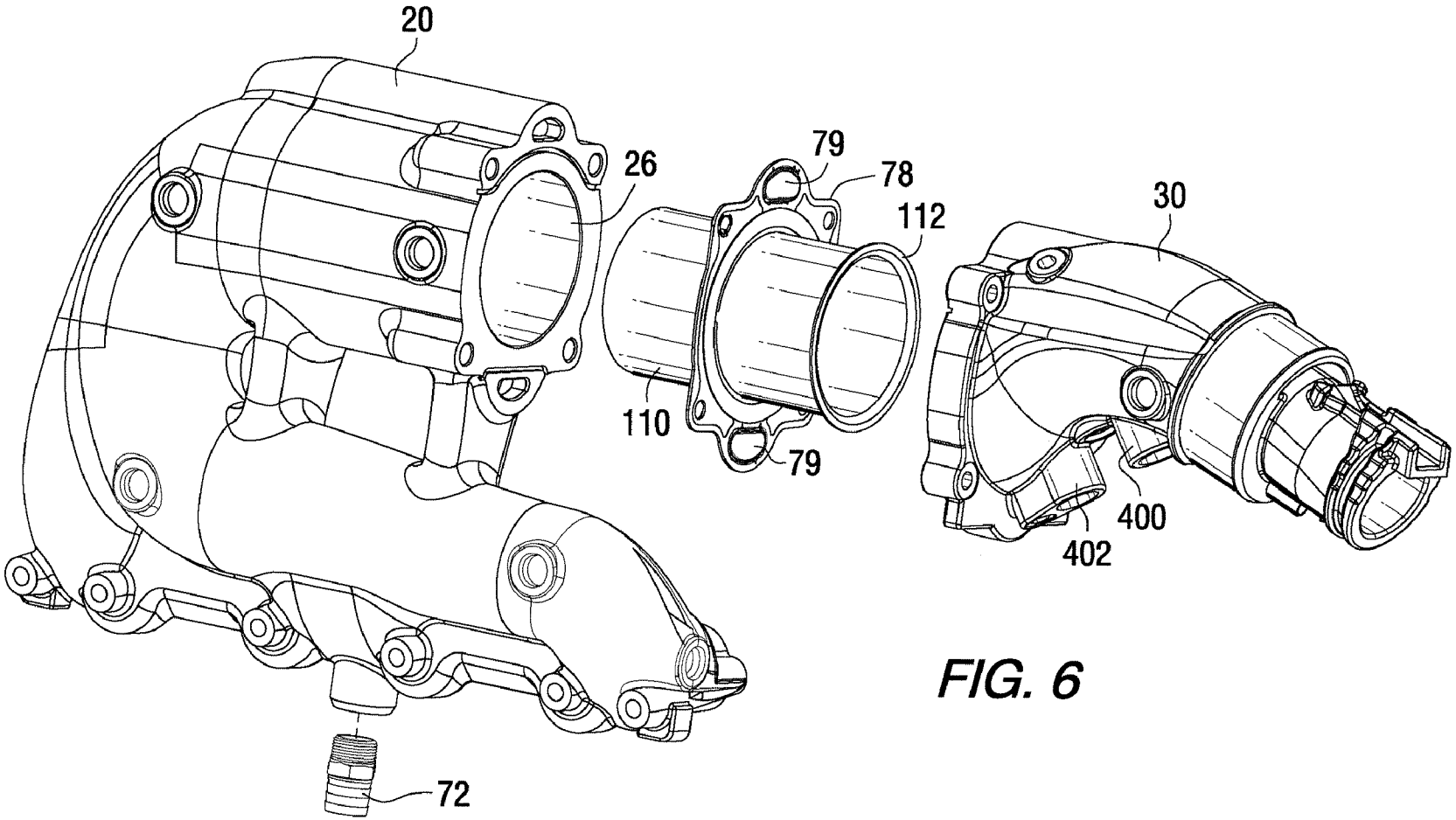
FIG. 6 is an exploded isometric view of a preferred embodiment of the present invention.

FIG. 6 is an exploded isometric view of a manifold structure 20, an elbow structure 30, a gasket 78, and a catalyzing component 110. In certain embodiments of the present invention, the catalyzing component 110 comprises a generally cylindrical tube which has a rim 112. Inside the tube, a catalyzing metal is contained and configured to allow exhaust gas to pass through the central portion of the tube and in contact with the surface area of the catalyzing material. As described above, in conjunction with FIGS. 3 and 5, the manifold exhaust conduit 22 comprises an outlet cavity 26. The outlet cavity 26 is shown in FIGS. 3, 5 and 6. The outlet cavity is shaped to receive the catalyzing component 110. The rim 112, in a preferred embodiment of the present invention, is shaped to be confined between opposing faces of the manifold 20 and the elbow 30. These two opposing faces also confine the gasket 78. In open cooling systems, the gasket 78 is provided with the openings 79 which are aligned with appropriate portions of the cooling jackets of both the manifold 20 and elbow 30. The relationship between the catalyzing component 110, and its rim 112, with the outlet cavity 26 of the manifold 20 and the inlet opening of the elbow 30 directs the exhaust flow 23 through the cylindrical tube of the catalyzing component 110 and in contact with the surface of the catalyst material contained within the cylindrical housing.

FIG. 7 is a section view of the elbow 30 that is used in an application, such as that illustrated in FIG. 5, where a dimensional requirement necessitates the use of an elbow which raises the exhaust outlet to a point higher than the type of application illustrated in FIGS. 3 and 6. The basic concepts of the present invention are similar, but certain dimensions are changed for the purpose of adapting those concepts to an exhaust system with different dimensional requirements. The elbow shown in FIG. 7 is generally the same as that shown in FIG. 5, but with certain components removed for clarity and the section view taken at a slightly different position so that the structure in FIG. 7 can be further sectioned to show the illustration of FIG. 8.

With continued reference to FIGS. 7 and 8, opening 200 is the location where fitting 85, as shown in FIG. 5, would be connected to direct the flow of bypass water either from the thermostat of an engine in an open cooling system or from the heat exchanger in a closed cooling system. That water flows into the outlet portion 60 of the water jacket and this water is then directed to flow in thermal communication with the outlet section 62 of the elbow exhaust conduit 32. Coolant flowing into the inlet portion 50 flows in thermal communication with the inlet section 52 of the elbow exhaust conduit 32. The obstruction 38 is generally aligned with dashed line 100 which is intended to show the plane in which the obstruction 38 is located. The passage 66 permits fluid communication between the inlet portion 50 and the outlet portion 60.

FIG. 8 is a section view of a portion of the elbow 30 illustrated in FIG. 7. The section view is taken along dashed line 100 and within the water dam provided by the obstruction 38. The passage 66 is shown in FIG. 8 at the upper portion of the elbow cooling jacket 37. With reference to FIGS. 3, 4, 5, 7 and 8, it can be seen that the basic principles of the preferred embodiment of the present invention are similar in both of these embodiments, whether the elbow provides a negligible rise, as in FIG. 3, or a significant rise as in FIGS. 5 and 7.

Figure 9:
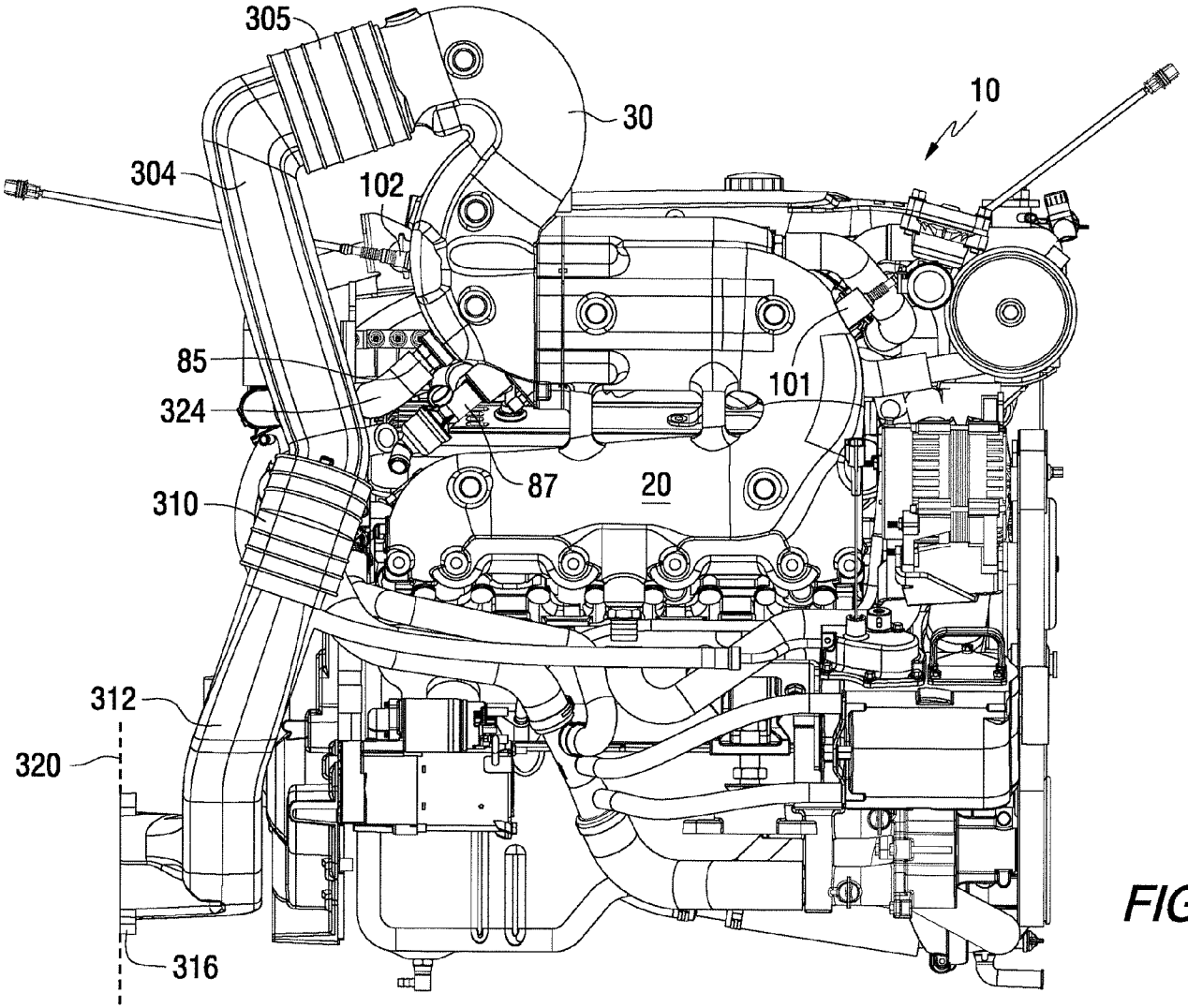
FIG. 9 is a side view of a marine engine incorporating a preferred embodiment of the present invention.

FIG. 9 is a side view of an engine 10 incorporating a manifold structure 20 and an elbow structure 30 made in accordance with a preferred embodiment of the present invention. The oxygen sensors, 101 and 102, are provided to allow comparison with the section view shown in FIG. 5. An elastomeric cylinder 305 connects the outlet end of the elbow structure 30 to an exhaust pipe 304. An additional elastomeric cylinder 310 connects the exhaust pipe 304 to another exhaust conduit 312 which is sometimes referred to as a "bullhorn". The flange 316 of the bullhorn 312 is attached to another component (not shown in FIG. 9) which directs exhaust gas through the plane defined by dashed line 320 and through a transom of a marine vessel to be discharged. A conduit 324 directs the flow of bypass water to a fitting 85 which directs the bypass water into the outlet portion 60 which is described above in conjunction with FIGS. 5 and 7. A pressure relief fitting 87 directs the flow of water into the inlet portion 50 of the elbow cooling jacket as described above in conjunction with FIG. 3. Since FIG. 9 shows the starboard side of the engine 10, it should be understood that another manifold structure 20 and elbow structure 30 is attached to the port side of the engine.

With reference to FIGS. 2-9, it can be seen that a marine exhaust system made in accordance with one or more preferred embodiments of the present invention comprises a manifold structure 20 and an elbow structure 30 which is attached to the manifold structure. It also comprises a manifold exhaust conduit 22 formed within the manifold structure 20 and configured to direct a flow of exhaust gas 23 from an engine 10 through a collection chamber 24 to an outlet cavity 26. It further comprises a manifold cooling jacket 28 which is disposed around a substantial portion of the manifold exhaust conduit 22. An elbow exhaust conduit 32 is formed within the elbow structure 30 and configured to direct a flow of exhaust gas 23 from an inlet opening 34 to an outlet opening 36. The elbow exhaust conduit 32 is connected in fluid communication with the manifold exhaust conduit 22 to direct the flow of exhaust gas 23 from the outlet cavity 26 to the inlet opening 34. An elbow cooling jacket 37 is disposed around a substantial portion of the elbow exhaust conduit 32 and an obstruction 38 is disposed within the elbow cooling jacket 37. The obstruction 38 is configured to divide the elbow cooling jacket 37 into an inlet portion 50 which surrounds a portion of an inlet section 52 of the elbow exhaust conduit 32 and an outlet portion 60 which surrounds a substantial portion of an outlet section 62 of the elbow exhaust conduit 32. The obstruction 38 has a passage 66 formed therein to conduct fluid between the inlet portion 50 and the outlet portion 60. A gasket 78 is disposed between the manifold structure 20 and the elbow structure 30 in a preferred embodiment of the present invention and the gasket 78 has an opening 79 formed through its thickness and configured to connect the manifold cooling jacket 28 in fluid communication with the elbow cooling jacket 37 in one embodiment of the present invention when it is used in association with an open cooling system. When used in association with a closed cooling system, the gasket 78 is configured to prevent fluid communication between the manifold cooling jacket 28 and the elbow cooling jacket 37. Particularly preferred embodiments of the present invention further comprise a first port 400 connected in fluid communication with the outlet portion 60 to continuously conduct fluid into the outlet portion when the engine 10 is operating. In certain embodiments of the present invention, it can further comprise a second port 402 connected in fluid communication with the inlet portion 50 to conduct fluid into the inlet portion when the pressure of the fluid, pumped from a body of water, exceeds a predefined threshold magnitude as determined by the pressure sensitive valve 80. A catalyzing component 110 is disposed within the outlet cavity 26 and configured to conduct a substantial portion of the flow of exhaust gas through the catalyzing component 110. The catalyzing component is retained in place by a portion, such as rim 112, of the catalyzing component being disposed between opposing surfaces of the manifold structure 20 and the elbow structure 30. When used in a closed cooling system, the manifold cooling jacket 28 is connected in fluid communication with a cooling jacket of the engine 10. A first coolant is contained within the closed cooling system for recirculation by a recirculating pump 522 through the manifold cooling jacket 28 and the cooling jacket of the engine 10. The elbow cooling jacket 37 is isolated from the manifold cooling jacket 28 and the cooling jacket of the engine 10. A second coolant is directed to flow through the elbow cooling jacket 37. In a typical application of the present invention, the second coolant is water drawn from a body of water. When used in an open cooling system, the manifold cooling jacket 28 is connected in fluid communication with a cooling jacket of the engine 10 and with the elbow cooling jacket 37. A first coolant is directed to flow through the open cooling system for passage through the cooling jacket of the engine 10, the manifold cooling jacket 28 and the elbow cooling jacket 37. The second coolant is water drawn from a body of water. In order to facilitate comparison of the various illustrations and to recognize certain similarities in the location of particular components, a stainless steel tube 470 is identified in FIGS. 1, 3, 5 and 7.

Although the present invention has been described in particular detail and illustrated to show different preferred embodiments, it should be understood that alternative embodiments are also within its scope.

We claim:

1. A marine exhaust system, comprising:

a manifold structure;

an elbow structure attached to said manifold structure;

a manifold exhaust conduit formed within said manifold structure and configured to direct a flow of exhaust gas from an engine through a collection chamber to an outlet cavity;

a manifold cooling jacket disposed around a substantial portion of said manifold exhaust conduit;

an elbow exhaust conduit formed within said elbow structure and configured to direct a flow of exhaust gas from an inlet opening to an outlet opening, said elbow exhaust conduit being connected in fluid communication with said manifold exhaust conduit to direct said flow of exhaust gas from said outlet cavity to said inlet opening;

an elbow cooling jacket disposed around a substantial portion of said elbow exhaust conduit;

an obstruction disposed within said elbow cooling jacket, said obstruction being configured to divide said elbow cooling jacket into an inlet portion which surrounds a substantial portion of an inlet section of said elbow exhaust conduit and an outlet portion which surrounds a substantial portion of an outlet section of said elbow exhaust conduit, said obstruction having a passage formed therein to conduct fluid between said inlet portion and said outlet portion; and a gasket disposed between said manifold structure and said elbow structure, said gasket being configured to prevent fluid communication between said manifold cooling jacket and said elbow cooling jacket.

2. The marine exhaust system of claim 1, wherein:

said gasket has an opening formed through its thickness and configured to connect said manifold cooling jacket in fluid communication with said elbow cooling jacket.

3. The marine exhaust system of claim 1, further comprising:

a first port connected in fluid communication with said outlet portion to continuously conduct fluid into said outlet portion when said engine is operating.

4. The marine exhaust system of claim 3, further comprising:

a second port connected in fluid communication with said inlet portion to conduct fluid into said inlet portion when the pressure of said fluid, pumped from a body of water, exceeds a predefined threshold magnitude.

5. The marine exhaust system of claim 1, further comprising:

a catalyzing component disposed within said outlet cavity and configured to conduct a substantial portion of said flow of exhaust gas through said catalyzing component.

6. The marine exhaust system of claim 5, wherein:

said catalyzing component is retained in place by a portion of said catalyzing component being disposed between opposing surfaces of said manifold structure and said elbow structure.

7. The marine exhaust system of claim 1, wherein:

said manifold cooling jacket is connected in fluid communication with a cooling jacket of said engine within a closed cooling system, a first coolant being contained with said closed cooling system for recirculation through said manifold cooling jacket and said cooling jacket of said engine; and said elbow cooling jacket is isolated from said manifold cooling jacket and said cooling jacket of said engine, a second coolant being directed to flow through said elbow cooling jacket, said second coolant being water drawn from a body of water.

8. The marine exhaust system of claim 1, wherein:

said manifold cooling jacket is connected in fluid communication with a cooling jacket of said engine and with said elbow cooling jacket within an open cooling system, a first coolant being directed to flow through said open cooling system for passage through said cooling jacket of said engine, said manifold cooling jacket and said elbow cooling jacket, said second coolant being water drawn from a body of water.

9. A marine exhaust system, comprising:

a manifold structure;

an elbow structure attached to said manifold structure;

a gasket disposed between said manifold structure and said elbow structure;

a manifold exhaust conduit formed within said manifold structure and configured to direct a flow of exhaust gas from an engine through a collection chamber to an outlet cavity;

a manifold cooling jacket disposed around a substantial portion of said manifold exhaust conduit;

an elbow exhaust conduit formed within said elbow structure and configured to direct a flow of exhaust gas from an inlet opening to an outlet opening, said elbow exhaust conduit being connected in fluid communication with said manifold exhaust conduit to direct said flow of exhaust gas from said outlet cavity to said inlet opening;

an elbow cooling jacket disposed around a substantial portion of said elbow exhaust conduit;

an obstruction disposed within said elbow cooling jacket, said obstruction being configured to divide said elbow cooling jacket into an inlet portion which surrounds a substantial portion of an inlet section of said elbow exhaust conduit and an outlet portion which surrounds a substantial portion of an outlet section of said elbow exhaust conduit, said obstruction having a passage formed therein to conduct fluid between said inlet portion and said outlet portion; and a first port connected in fluid communication with said outlet portion to continuously conduct fluid into said outlet portion when said engine is operating; and a catalyzing component disposed within said outlet cavity and configured to conduct a substantial portion of said flow of exhaust gas through said catalyzing component said catalyzing component being retained in place by a portion of said catalyzing component being disposed between opposing surfaces of said manifold structure and said elbow structure.

10. The marine exhaust system of claim 9, wherein:

said manifold cooling jacket is connected in fluid communication with a cooling jacket of said engine within a closed cooling system, a first coolant being contained with said closed cooling system for recirculation through said manifold cooling jacket and said cooling jacket of said engine; and said elbow cooling jacket is isolated from said manifold cooling jacket and said cooling jacket of said engine, a second coolant being directed to flow through said elbow cooling jacket, said second coolant being water drawn from a body of water, said gasket being configured to prevent fluid communication between said manifold cooling jacket and said elbow cooling jacket.

11. The marine exhaust system of claim 10, further comprising:

a second port connected in fluid communication with said inlet portion to conduct fluid into said inlet portion when the pressure of said fluid, pumped from a body of water, exceeds a predefined threshold magnitude.

12. The marine exhaust system of claim 9, wherein:

said manifold cooling jacket is connected in fluid communication with a cooling jacket of said engine and with said elbow cooling jacket within an open cooling system, a first coolant being directed to flow through said open cooling system for passage through said cooling jacket of said engine, said manifold cooling jacket and said elbow cooling jacket, said second coolant being water drawn from a body of water, said gasket having an opening formed through its thickness and configured to connect said manifold cooling jacket in fluid communication with said elbow cooling jacket.

13. A marine exhaust system, comprising:

a manifold structure;

an elbow structure attached to said manifold structure;

a gasket disposed between said manifold structure and said elbow structure;

a manifold exhaust conduit formed within said manifold structure and configured to direct a flow of exhaust gas from an engine through a collection chamber to an outlet cavity;

a manifold cooling jacket disposed around a substantial portion of said manifold exhaust conduit;

an elbow exhaust conduit formed within said elbow structure and configured to direct a flow of exhaust gas from an inlet opening to an outlet opening, said elbow exhaust conduit being connected in fluid communication with said manifold exhaust conduit to direct said flow of exhaust gas from said outlet cavity to said inlet opening;

an elbow cooling jacket disposed around a substantial portion of said elbow exhaust conduit;

an obstruction disposed within said elbow cooling jacket, said obstruction being configured to divide said elbow cooling jacket into an inlet portion which surrounds a substantial portion of an inlet section of said elbow exhaust conduit and an outlet portion which surrounds a substantial portion of an outlet section of said elbow exhaust conduit, said obstruction having a passage formed therein to conduct fluid between said inlet portion and said outlet portion; and a catalyzing component disposed within said outlet cavity and configured to conduct a substantial portion of said flow of exhaust gas through said catalyzing component, said manifold cooling jacket being connected in fluid communication with a cooling jacket of said engine within a closed cooling system, a first coolant being contained with said closed cooling system for recirculation through said manifold cooling jacket and said cooling jacket of said engine, said elbow cooling jacket being isolated from said manifold cooling jacket and said cooling jacket of said engine, a second coolant being directed to flow through said elbow cooling jacket, said second coolant being water drawn from a body of water, said gasket being configured to prevent fluid communication between said manifold cooling jacket and said elbow cooling jacket.

14. The marine exhaust system of claim 13, wherein:

said manifold cooling jacket is connected in fluid communication with a cooling jacket of said engine and with said elbow cooling jacket within an open cooling system, a first coolant being directed to flow through said open cooling system for passage through said cooling jacket of said engine, said manifold cooling jacket and said elbow cooling jacket, said second coolant being water drawn from a body of water, said gasket having an opening formed through its thickness and configured to connect said manifold cooling jacket in fluid communication with said elbow cooling jacket.

* * * * *